United States Patent [19]

Katoh

[11] Patent Number: 4,672,160

[45] Date of Patent: Jun. 9, 1987

[54] DOOR SAFETY SWITCH-LOCK ASSEMBLY FOR AN ELECTRICAL APPARATUS

[75] Inventor: Kiroyuki Katoh, Osaka, Japan

[73] Assignee: Sharp Kabushiki Kaisha, Osaka, Japan

[21] Appl. No.: 829,008

[22] Filed: Feb. 13, 1986

[30] Foreign Application Priority Data

Feb. 15, 1985 [JP] Japan ..... 60-20634[U]

[51] Int. Cl.[4] ..... H05B 6/68; H01H 9/22

[52] U.S. Cl. ..... 219/10.55 C; 126/197; 200/50 A

[58] Field of Search ..... 219/10.55 C, 10.55 B; 126/197; 200/50 A, 50 R, 50 C, 61.62, 61.64

[56] References Cited

U.S. PATENT DOCUMENTS 3,967,088 6/1976 Horiuchi ..... 219/10.55 C
4,117,294 9/1978 Appelquist et al. ..... 219/10.55 C
4,323,747 4/1982 Takase et al. ..... 219/10.55 C
4,504,719 3/1985 Taylor, Jr. et al. ..... 219/10.55 C
4,511,780 4/1985 Okamura ..... 219/10.55 C

*Primary Examiner*—Philip H. Leung
*Attorney, Agent, or Firm*—Birch, Stewart, Kolasch & Birch

[57] ABSTRACT

A heating appliance including an oven housing, an oven door attached to the oven housing which can be operated between a closed and an opened position to provide access to the interior of the oven housing, a door latching assembly for securing the oven door for opening and closing the oven housing, the door latching assembly including a latch head disposed on the oven door and a latch hook provided in the oven housing for engaging with and disengaging from the latch head, a first switch disposed in the oven housing, the first switch being directly switched by the latch head, and a second switch disposed in the oven housing, the second switch being directly switched by the latch head after the switching of the first switch.

10 Claims, 10 Drawing Figures

FIG. 6
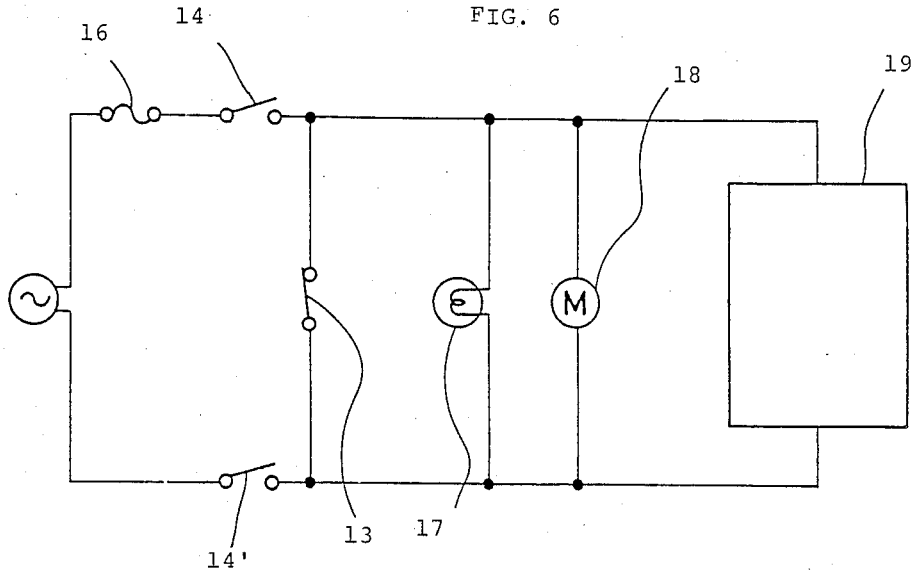
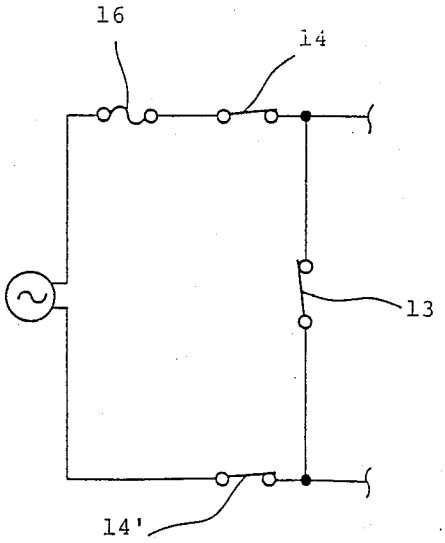
FIG. 7

FIG. 9
PRIOR ART
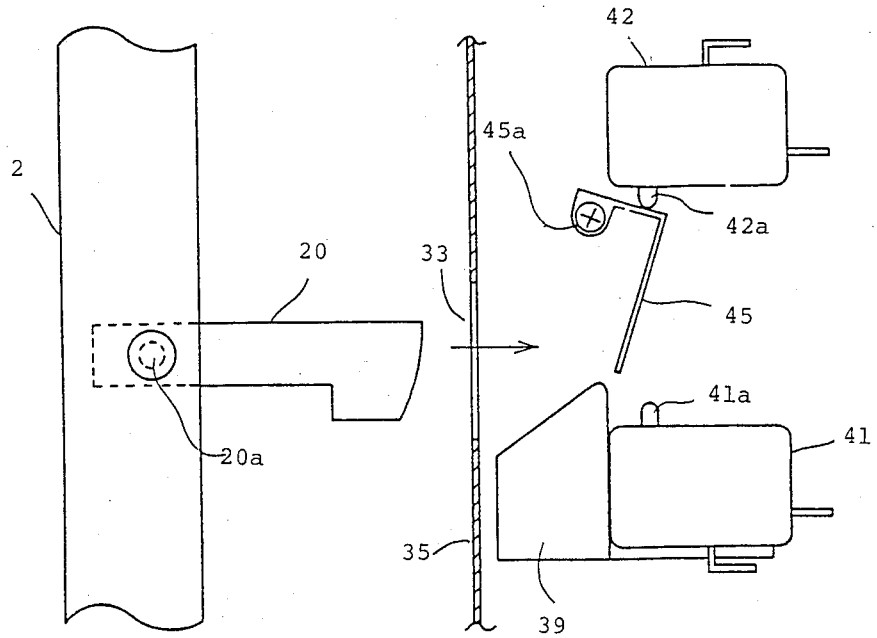
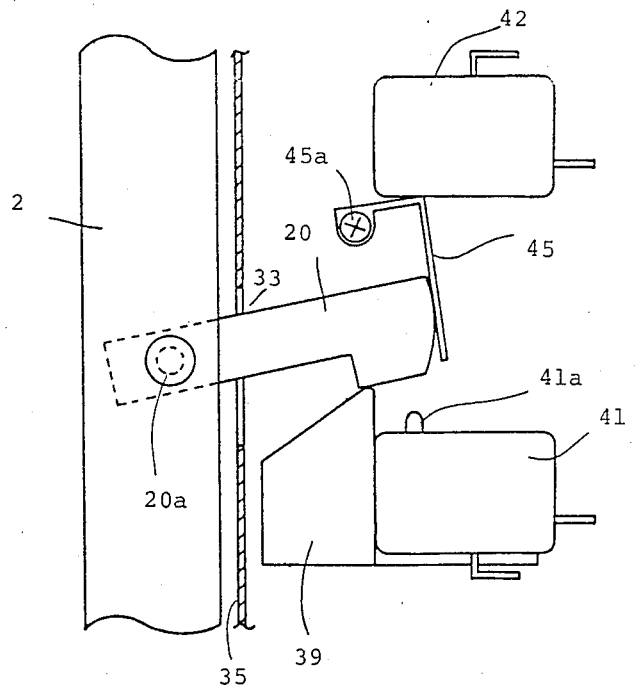
FIG. 10 PRIOR ART

DOOR SAFETY SWITCH-LOCK ASSEMBLY FOR AN ELECTRICAL APPARATUS

BACKGROUND OF THE INVENTION

The present invention relates to a heat appliance and, more particularly, to a switching assembly for a heating appliance which operates in response to the door opening and closing operations of a heating appliance such as a microwave oven.

A conventional switching assembly for a heating appliance is as shown in FIG. 8, and is disclosed in U.S. Pat. No. 4,542,269, entitled "COOKING APPLIANCE WITH SWITCHING ASSEMBLY" by Yasuhiro Sakoda.

Movable latch heads 20 and 21 are, respectively, held by pins 23 and 24, to allow free movement. The latch heads 20 and 21 are connected to a connector lever 25 by pins 26 and 27, respectively. The connector lever 25 is constantly biassed by a spring 28 in the direction of arrow A, and is movable vertically. A door handle 22 is coupled to the latch heads 20 and 21 with pins 29 and 30. When the door handle 22 is pulled in the direction of arrow B, the latch heads 20 and 21 turn counterclockwise around pivot pins 23 and 24. As a result, fingers 31 and 32 at the tips of the latch heads 20 and 21, respectively, moved in the direction of arrow C. Openings 33 and 34 which are provided on the front panel 35, allow the latch heads 20 and 21 to freely enter or leave the space behind the front panel 35. First and second switch base plates 37 and 38 are respectively secured to the upper and lower parts of the bent side wall 36 of the front panel 35. Latch hooks 39 and 40, engageable with the latch heads 20 and 21, are integrally secured to the first and second switch base plates 37 and 38 respectively. When the oven door 2 is closed, the latch heads 39 and 40, respectively, engage the fingers 31 and 32 of the latch heads 20 and 21, thus securely locking the oven door 2 of the microwave oven. The first switch base plate 37 is provided with a first safety switch 41 of a normally open type and a monitor switch 42 of a normally close type. The second switch base plate 38 is provided with a second safety switch 43 of a normally open type. The second safety switch 43 is a control switch and also functions as a heating switch in cooperation with a heating lever or operating lever 44. These switches 41, 42, and 43 are respectively built into the door locking mechanism so that they can be activated in conjunction with the latch heads 20 and 21, respectively. Thus, the monitor switch 42 is under the control of the L-shaped switch lever 45 which is movable by the depressing movement of the point of the latch head 20. A conventional door mechanism is, also, disclosed in U.S. Pat. No. 4,341,409, entitled "DOOR LATCHING ASSEMBLY", by Yasuhiro Sakoda.

In the conventional switching assembly, the L-shaped switching lever is additionally required for switching the first safety switch 41 and the monitor switch 42, thus requiring much labor during assembly, and making it difficult to reduce the cost and make the compact switching assembly.

SUMMARY OF THE INVENTION

Accordingly, it is an object of the present invention to provide an improved switching assembly for a heating appliance comprising a simplified mechanism.

It is another object of the present invention to provide an improved switching assembly for a heating appliance which allows a smooth switching operation.

It is a further object of the present invention to provide an improved switching assembly for a heating appliance which operates a pair of swithces in response to the movement of a latch head and a latch mechanism.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above objects, according to the present invention, a heating apliance comprises an oven housing, an oven door attached to said oven housing which can be operated between a closed and an opened position to provide access to the interior of said oven housing, a doot latching assembly for securing said oven door for opening and closing said oven housing, said door latching assembly comprising a latch head disposed on said oven door and a latch hook provided in said oven housing for engaging with and disengaging from said latch head, first switch means disposed in said oven housing, said first switch means being directly switched by said latch head, and second switch means disposed in said oven housing, said second switch means being directly switched by said latch head after the switching of said first switch means. Said contact actuator of said first switch means is directly touched by said latch head.

BRIEF DESCRIPTION OF THE DRAWINGS

The present invention will be better undertsood from the detailed description given hereinbelow and the accompanying drawings which are given by way of illustration only, and thus are not limitative of the present invention and wherein:

FIG. 6 shows an electrical circuit of a microwave oven;

FIG. 7 shows an electrical circuit of the microwave oven when the safety switches are closed;

FIG. 9 shows a sectional view of the switching assembly of FIG. 8 when the oven door is open; and FIG. 10 shows a sectional view of the switching assembly of FIG. 9 with the oven door partly closed.

DETAILED DESCRIPTION OF THE PREFERRED EMBODIMENTS

Figure 1:
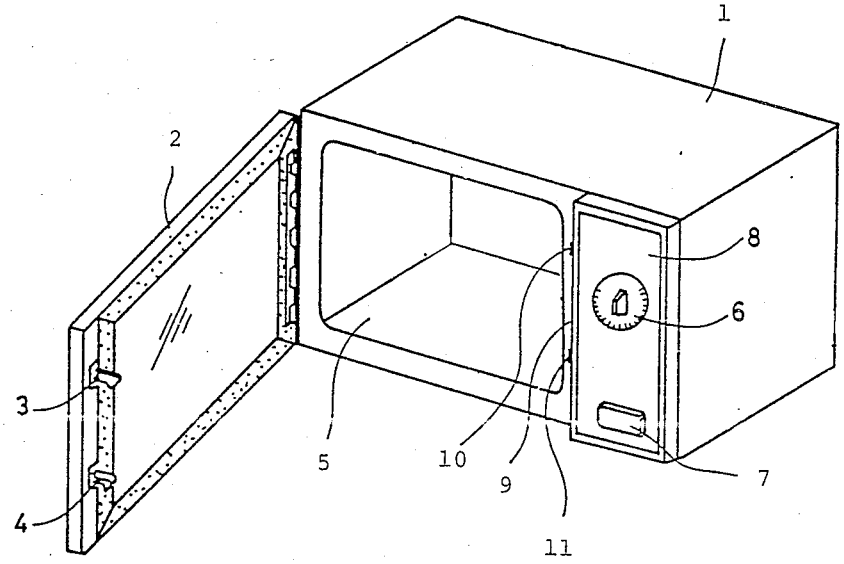
FIG. 1 shows a perspective view of a microwave oven including a switching assembly according to an embodiment of the present invention.
Figure 2:
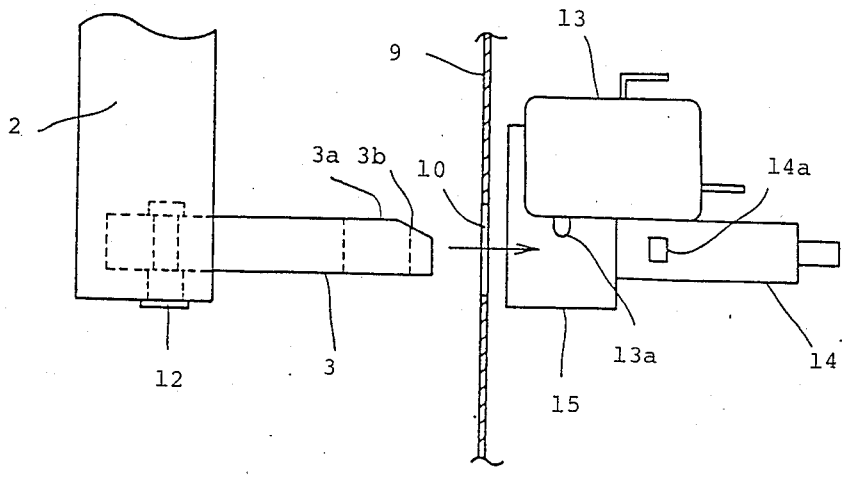
FIG. 2 shows an upper plan view of a switching assembly according to an embodiment of the present invention when an oven door is open.
Figure 3:
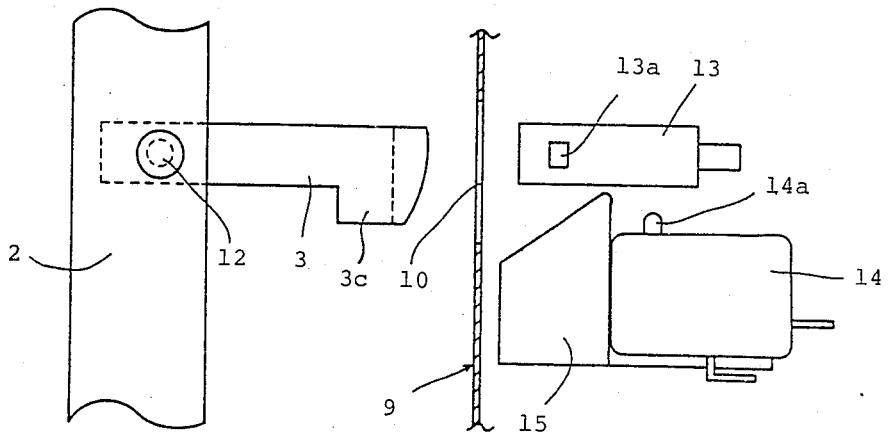
FIG. 3 shows a sectional view of the switching assembly of FIG. 2.
Figure 4:
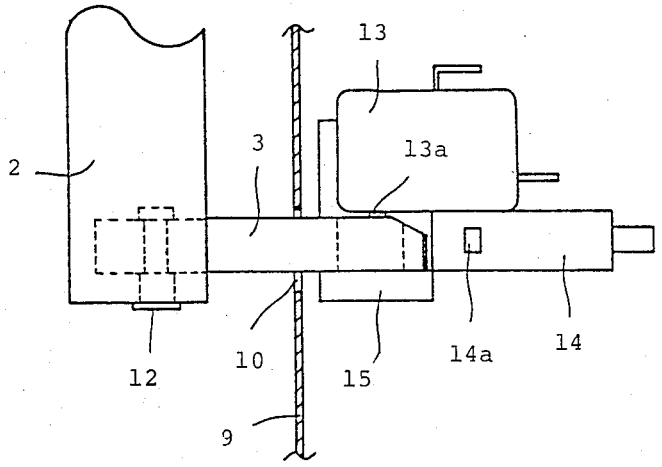
FIG. 4 shows an upper plan view of the switching assembly according to an enbodiment of the present invention with the oven door partly closed.
Figure 5:
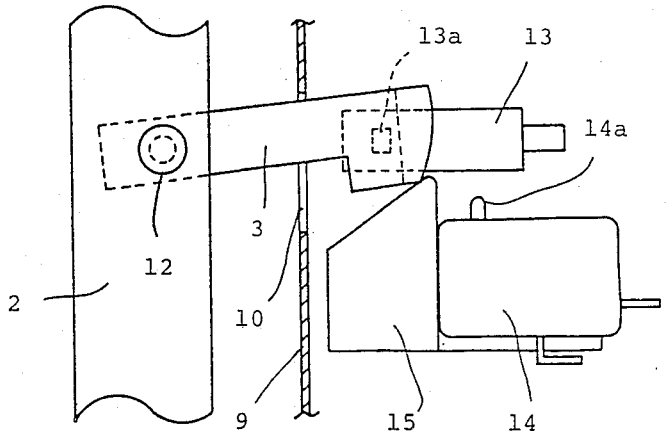
FIG. 5 shows a sectional view of the switching assembly of FIG. 4.

FIG. 1 shows a perspective view of a microwave oven including a switching assembly of a preferred embodiment of the present invention. The present invention may be applied to various apparatus other than a microwave oven.

An oven door 2 is secured to a microwave oven 1 via a hinge. Movable latch heads 3 and 4 are provided at the right edge of the inner door periphery, each protruding from the inner door edge surface and having a finger in a tip portion thereof. A control panel 8 that accomodates a timer 6 and a heating button 7 is installed at the right-hand front panel of the microwave oven 1. With food (not shown) being placed in the oven cavity 5, after the closure of the oven door 2, and subsequent manual depression of the heating button 7, cooking (or heating) is performed for a predetermined period by the timer 6.

FIG. 6 shows an electrical circuit of the microwave oven. A safety switch 14 which functions as a door switch is closed when the oven door 2 is closed. The safety switch 14 is of the normally closed type, for example, an interlock switch. A monitor switch 13 is opened when the oven door 2 is closed. The monitor switch is of the normally close type A fuse is designated by numeral 16. When a rated voltage is applied to the circuit of FIG. 6, the oven door 2 is closed, and a cook switch is closed by the heating button 7, a voltage is applied to the microwave generator 19 such as a magnetron to generate the microwaves into the oven cavity 5. The heating thereby starts.

After heating is completed, in case the oven door 2 is opened and contact actuator 14*a* of the safety switch 14 is not opened due to malfunctioning, the circuit of the microwave oven is short-circuited by the monitor switch 13 as shown in FIG. 7 so that the fuse 16 is forcibly melted. Accordingly, unnecessary microwaves are not generated for safety measure.

However, the circuit of the microwave oven may be short-circuited at a moment when the safety switch 14 and the monitor switch 13 are operated at the same time possibly causing fuel 51 to melt.

To resolve this problem in the conventional switching assembly as shown in FIGS. 9 and 10, the L-shaped lever 45 is provided between the monitor switch 42 and the safety switch 41. The latch head 20 presses the L-shaped lever 45 due to the substantially forward movement of the latch head 20 which pivots around pin 20*a* by a constant angle. First the contact actuator 42*a* is depressed resulting in the opening of monitor switch 42 followed by contact actuator 41*a* being depressed resulting in the closing of safety switch 41 by means of finger 31 of the latch head 20.

In the conventional switching assembly, the additional components such as the L-shaped lever 45 and the pin 45*a* are required. Making it difficult to reduce the costs and to make the contact switching assembly.

The preferred embodiment of the present invention will be described below with reference to FIGS. 2 through 5. A latch head 3 is rotatably connected with an oven door 2, and is pivotally rotated around a pin 12 by a predetermined angle. A latch hook 15 is provided in the oven housing covering the oven cavity 5 and secured adjacent of the front panel 12 of the oven. The finger 3*c* of the latch head 3 is engaged with or disengaged from the latch hook 15 according to the opening and closing operations of the oven door 2. A contact actuator 13*a* of a monitor switch 13 is pressed by the side face 3*b* of the latch head 3 according to the door closing operation. A contact actuator 14*a* of a safety switch 14 is pressed by the finger 3*c* of the latch head 3 according to the door closing operation. The position of the contact actuator 13*a* of monitor switch 13 is provided adjacent and closer to the oven door than the position of the contact actuator 14*a* of the safety switch 14. The latch head 3 is pivotably mounted on pin 12 for pivoting about a predetermined constant angle, and is biassed by a spring (not shown) in the clockwise direction. The portion 3*b* of the latch head 3 is inclined so that the contact actuator 13*a* of the monitor switch 13 can be depressed by side wall 3*b* of the latch head 3. An opening 10 is provided at the front panel 9 of the oven housing to allow the latch head 3 to freely enter into or leave the space behind the front panel 9 of the oven. The latch hook 15 is provided behind the front panel 9 and adjacent to the space.

The safety switch 14 is provided adjacent to the latch hook 15 and includes contact actuator 14*a* projecting into the path of movement of the latch head 3. The monitor switch 13 is provided above the latch hook 15 and the safety switch 14. The contact actuator 13*a* of the monitor switch 13 projects into the path of movement of the latch head 3. The contact actuators 13*a* and 14*a* are provided on the path of the movement of the latch head 3. The latch head 3 is moved substantially in the horizontal direction, and is rotated about pin 12 when the latch head 3 is moved along the latch hook 15. The direction of actuating the contact actuator 13*a* is perpendicular to a direction to actuating the contact actuator 14*a*. The contact actuator 13*a* is provided closer to the front panel 9 than the contact actuator 14*a* so that the actuating timings of the contact actuators 13*a* and 14*a* are different from each other. The contact actuators 13*a* and 14*a* are touched or depressed by the latch head 3 in response to the closing operation of the door.

Figure 8:
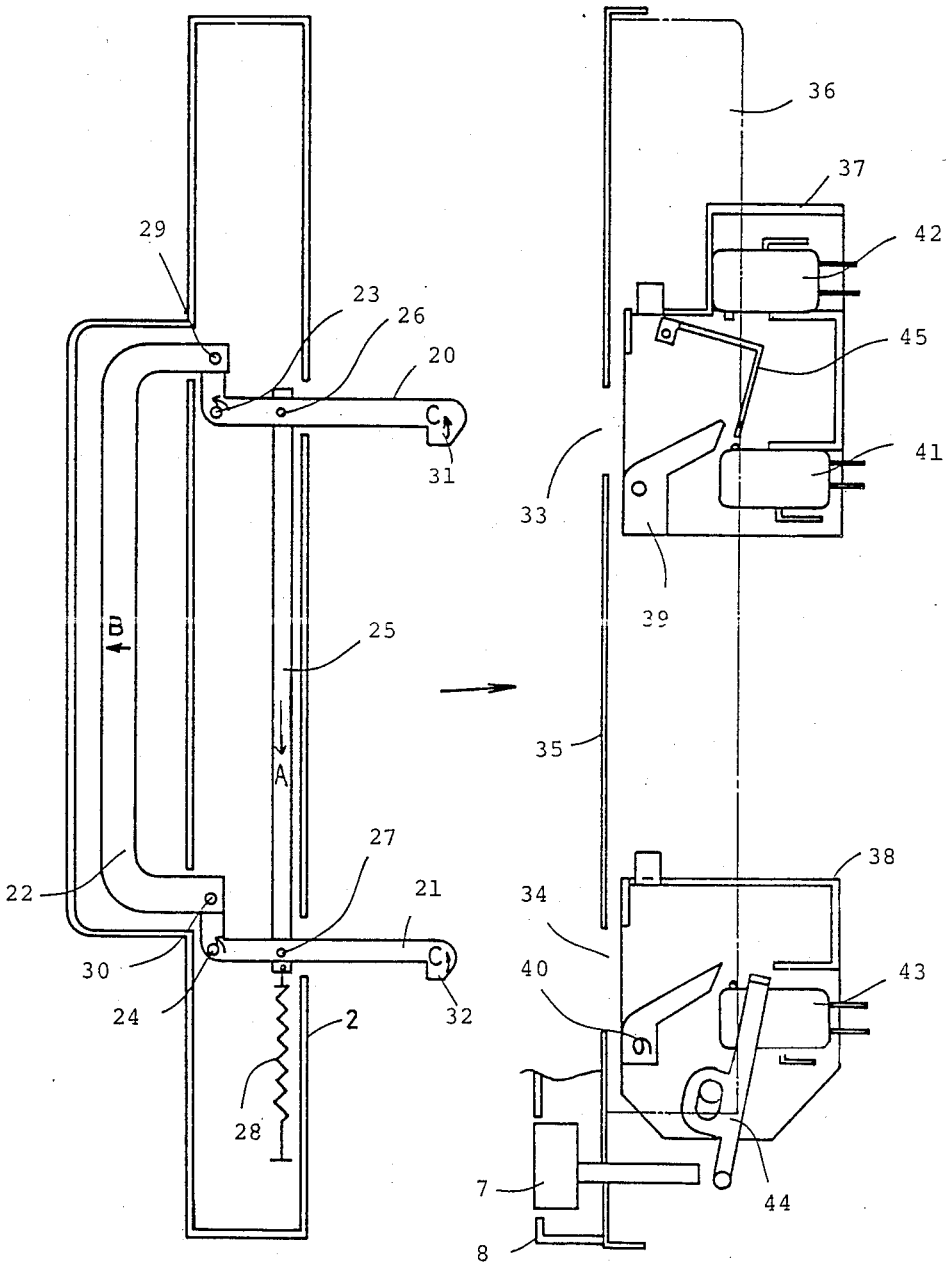
FIG. 8 PRIOR ART
FIG. 8 shows a sectional view of the conventional switching assembly.

The monitor switch 13 and the safety switch 14 may be provided on a switch base plate of the type shown in FIG. 8. A pair of safety switches may be provided at the upper portion and the lower portion of the oven housing similar to the positioning of the switches in the conventional device as shown in FIG. 8, and may cooperate with a pair of latch heads 3 and 4 provied on the oven door as shown in FIG. 1.

In the above construction, when the oven door 2 is closed, the latch head 3 is inserted between the monitor switch 13 and the safety switch 14 and engaged with the latch hook 15. Upon closing oven door 2, first, the tip of the latch head 3 presses the contact actuator 13*a* of the monitor switch 13 disposed near the oven door 2 so that the contact of the monitor switch 13 is opened so as to open the safety circuit. Second, the finger 3*c* at the tip of the latch head 3 depresses the contact actuator 14*a* of the safety switch 14 so that the contact of the safety switch 14 is closed so as to close the main circuit of the microwave oven. Thereafter, when the cook switch is switched on by the cook button 7, the microwave generator 19 such as a magnetron are driven so as to start the cooking. When the oven door 2 is opened after the cooking is completed, the latch head 3 is lifted up or pivoted in the counterclockwise direction along the latch hook 15 by a connector lever (for example, the connecting lever 25 as shown in FIG. 8). The depression of contact actuator 14*a* of the safety switch 14 is released so that the contact of the safety switch 14 is opened so as to open the main circuit of the microwave oven. The depression of contact actuator 13*a* of the monitor switch 13 is then released so that the contact of the monitor switch 13 is closed so as to close the safety circuit.

The release operations of the latch head 3 from the monitor switch 13 and the safety switch 14 are not carried out at the same time because the contact actuator 13*a* of the monitor switch 13 and the contact actuator 14*a* of the safety switch 14 are separated each other on the path of the movement of the latch head 3. Accordingly, the opening and closing operations of the contacts of the monitor switch 13 and the safety switch 14 are smoothly and separately performed. The opening and closing operations of the contact actuators 13*a* and 14*a* of the monitor switch 13 and safety switch 14 respectively is under the control of the latch head 3 which is movable with the oven door 2 between the door closing position and the door opening position, and is rotatable about the pin 12.

As described above, the switching assembly for the heating appliance comprises a latch head provided on the oven door, a latch hook provided on the oven housing including the oven cavity for engaging with or desengaging from the latch head, the monitor switch in which the contact actuator of the monitor switch is depressed by the latch head when the door is closed, the safety switch in which the contact actuator of the safety switch is depressed when the door is closed, wherein the contact actuator of the monitor switch is provided adjacent or near the oven door and the contact actuator of the safety switch is further from the oven door relative the contact actuator of the monitor switch. Accordingly, the opening and closing operations of the contact actuators of the monitor switch respectively and the safety switch are smoothly performed and are directly carried out by the latch head without the additional components such as the L-shaped lever. As the contact actuator of the monitor switch is provided on the path of movement of the latch head adjacent or near the oven door, and the contact of the safety switch is further from the oven door, the opening and the closing timings of the safety switch are different from the closing and opening timings of the monitor switch, respectively. The contact actuators 13*a* and 14*a* are directly touched or depressed by the latch head 3. The tip of the latch head 3 is positioned beteen the contact actuator 13*a* and the contact actuator 14*a*.

The switches should not be limited to the safety switch and the monitor switch. Various switches other than the safety switch and the monitor switch may be used.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A door safety switch-lock assembly in combination with an electrical apparatus having an electronic circuit and an access door, said assembly comprising:

a latch head pivotally mounted to the access door about a pivotal axis, said latch head extending outwardly from the access door towards the electrical apparatus, a finger extending from said latch head in a direction substantially perpendicular to said pivotal axis and extending from said latch head at a predetrmined distance from said pivotal axis, said latch head having a face confined to a plane of movement substantially perpendicular to said pivotal axis;

a latch hook mounted to the electrical apparatus, said finger engages with said latch hook for locking the access door closed upon closing the access door;

a first switch means mounted to the electrical apparatus for engaging with said face of said latch head for switching said first switch means upon partly closing the access door, said face of said latch head continuously engages said first switch upon the access door being further closed whereby said latch head pivots about its pivotal axis due to the engagement of said latch head with said latch hook, said first switch being a component in the electronic circuit;

a second switch means, mounted on the electrical apparatus at a distance further from the access door relative said first switch for providing engagement of said finger of said latch head with said second switch means for switching said second switch means at a delayed period of time after contact with said first switch means upon closing the access door, said second switch is positioned on the electrical apparatus so that said finger engages said second switch means after said finger engages with said latch hook upon completely closing the access door, said second switch being a component in the electronic circuit.

2. The assembly according to claim 1, including a biasing means for resiliently maintaining said latch head, pivotally mounted on the access door, in a position substantially perpendicular relative the access door, wherein said latch hook includes a ramp portion on which said latch head engages and rides upon closing the access door, said latch hook includes an edge adjacent said ramp portion on which said finger of said latch head catches upon completely closing the access door.

3. The assembly according to claim 2, wherein said finger of said latch head includes a first ramp portion at an end of said latch head that extends from the access door for engaging with said latch hook upon closing the access door, said latch head includes a second ramp portion at said end of said latch head adjacent said face for engaging said first switch means upon closing the access door.

4. The assembly according to claim 3, wherein said first switch means is a monitor switch for short-circuiting the electronic circuit to activate a fuse in the electronic circuit in the event said second switch malfunctions, said second switch means being a safety switch for closing and opening the electronic circuit to a power source upon closing and opening the access door, respectively.

5. The assembly according to claim 2, wherein said first switch means is a monitor switch for short-circuiting the electronic circuit to activate a fuse in the electronic circuit in the event said second switch malfunctions, said second switch means being a safety switch for closing and opening the electronic circuit to a power source upon closing and opening the access door, respectively.

6. The assembly according to claim 1, wherein said finger of said latch head includes a first ramp portion at an end of said latch head that extends from the access door for engaging with said latch hook upon closing the access door, said latch head includes a second ramp portion at said end of said latch head adjacent said face for engaging said first switch means upon closing the access door.

7. The assembly according to claim 6, wherein said first switch means is a monitor switch for short-circuiting the electronic circuit to activate a fuse in the electronic circuit in the event said second switch malfunctions, said second switch means being a safety switch for closing and opening the electronic circuit to a power upon closing and opening the access door, respectively.

8. The assembly according to claim 1, wherein said first switch means is a monitor switch for short-circuiting the electronic circuit to activate a fuse in the electronic circuit in the event that said second switch malfunctions, said second switch means being a safety switch for closing and opening the electronic circuit to a power source upon closing and opening the access door, respectively.

9. A door safety switch-lock combination assembly in combination with a microwave oven having an access door and an electrical circuit, said assembly comprising:

a latch head pivotally mounted to the access door about a pivotal axis, said latch head extending outwardly from the access door towards the microwave oven, a finger extending from said latch head in a direction substantially perpendicular to said pivotal axis and extending from said latch head at a predetermined distance from said pivotal axis, said latch head having a face confined within a plane of movement substantially perpendicular to said pivotal axis;

a latch hook mounted to the microwave oven, said finger engages with said latch hook for locking the access door closed upon closing the access door;

a first switch means mounted to the microwave oven for engaging with said face of said latch head for switching said first switch means upon partly closing the access door, said face of said latch head continuously engages said first switch upon the access door being further closed whereby said latch head pivots about its pivotal axis due to the engagement of said latch head with said latch hook, said first switch being a component in the electrical circuit;

a second switch means, mounted to the microwave oven at a distance further from the access door relative said first switch for providing engagement of said finger of said latch head with said second switch means for switching said second switch means at a delayed period of time after contact with said first switch means upon closing the access door, said second switch is positioned on the electrical apparatus so that said finger engages said second switch means after said finger engages with said latch hook upon completely closing the access door, said second switch being a component in the electrical circuit.

10. The assembly according to claim 9, including a biasing means for resiliently maintaining said latch head, pivotally mounted on the access door, in a position substantially perpendicular relative of the access door, wherein said latch hook includes a ramp portion on which said latch head engages and rides upon closing the access door, said latch hook includes an edge adjacent said ramp portion on which said finger of said latch head catches upon completely closing the access door.

* * * * *